United States Patent [19]

Ichikawa et al.

[11] 4,444,226

[45] Apr. 24, 1984

[54] DEVICE FOR MEASURING THE LENGTH OF A WEFT IN A SHUTTLELESS LOOM

[75] Inventors: Kimio Ichikawa, Higashiura; Hiroshi Arakawa, Kariya; Takeshi Nakamura, Gamagori, all of Japan

[73] Assignee: Kabushiki Kaisha Toyoda Jidoshokki Seisakusho, Kariya, Japan

[21] Appl. No.: 330,965

[22] Filed: Dec. 15, 1981

[30] Foreign Application Priority Data

| | | | |
|---|---|---|---|
| Dec. 20, 1980 | [JP] | Japan | 55-181075 |
| Dec. 22, 1980 | [JP] | Japan | 55-181677 |
| Dec. 22, 1980 | [JP] | Japan | 55-181678 |
| Aug. 25, 1981 | [JP] | Japan | 56-132063 |

[51] Int. Cl.[3] ..... D03D 47/36

[52] U.S. Cl. ..... 139/452; 242/47.01

[58] Field of Search ..... 139/452; 242/47.01, 242/47.12; 66/132 R

[56] References Cited

U.S. PATENT DOCUMENTS

| | | | |
|---|---|---|---|
| 3,971,522 | 7/1976 | Pfarrwaller | 139/452 |
| 4,372,349 | 2/1983 | Mullekom | 139/452 |
| 4,372,498 | 2/1983 | Mullekom | 139/452 |
| 4,381,807 | 5/1983 | Umezawa et al. | 139/452 |

*Primary Examiner*—Henry Jaudon

*Attorney, Agent, or Firm*—Brooks, Haidt, Haffner & Delahunty

[57] ABSTRACT

A weft length measuring device comprising a weft storage drum supported against rotation and a weft winding member rotatable around the drum to wind a weft thereon is disclosed.

According to this invention, the measuring device further comprises a length measuring control or retaining pin and a weft unwinding control pin arranged a pair at axially spaced positions in the weft storage drum and operated by a cam mechanism so as to alternately project out of the weft storage drum at appropriate times in the weft inserting cycle, and a weft transfer member arranged on the outer periphery of the weft storage drum to cause the weft for one weft insertion, the length of which has been measured by the rearwardly disposed rearward, length measuring pin, to be transferred toward the forward, weft unwinding control pin. During the weft inserting operation during which the weft wound on the drum is unwound, a succeeding weft for the next weft insertion can be continuously and exactly wound on the storage drum.

13 Claims, 13 Drawing Figures

DEVICE FOR MEASURING THE LENGTH OF A WEFT IN A SHUTTLELESS LOOM

BACKGROUND OF THE INVENTION

This invention relates to a device for measuring the length of a weft for shuttleless looms, such as a jet loom.

Generally, in a jet loom, a predetermined length of weft required for one weft inserting operation is preliminarily transferred with an air flow toward a storge pipe, and stored therein and the stored weft is caused by the air flow to be transferred through a warp shed upon weft insertion. Such a weft length measuring device, of the so-colled pipe type causes the stored weft to be subject to a relatively strong resistance when it is drawn out of the pipe by the air flow upon the weft insertion. Furthermore, since the transfer of the weft into the storage pipe relies on the air flow, it is difficult to store the exact length of a weft in the pipe. This results in disadvantages, such as an unreliable weft inserting operation leading to a weft insertion error.

In order to remove the disadvantages of said so-called pipe type measuring device, heretofore, a drum type measuring device has been provided as disclosed, for example, in Japanese patent specification No. 46-4872, which device comprises a weft storage drum mounted against rotation, and a weft guide mounted for rotation around the drum to cause the weft supplied from a weft supply bobbin to be wound continuously on the drum periphery in the form of a coil and the wound weft to be unwound upon the weft insertion. However, said device in Japanese patent specification No. 46-4872 is for a gripper loom and is not required to exactly measure the length of a weft necessary for one weft insertion. Therefore, even if said device were intended for use in an air jet loom, it would not be utilized in practice because of relatively great variations in the length of a weft unwound from the weft storage drum during every weft inserting operation.

Furthermore, in said drum type device, when the weft is unwound from the storage drum at the weft insertion, the weft is subject to a smaller resistance than in the so-called pipe device. Also, the drum type device contributes to a stable weft inserting operation. However, the resistance, which the weft is subject to in the drum type device, is not small enough, since the outer peripheral surface of the weft storage drum is made simply in a substantially cylindrical form, which causes the whole weft on the drum to be in sliding contact with the outer peripheral surface of said storage drum when it is unwound therefrom.

It is further stated that the storage drum is of one-piece integral formation so that its diameter remains unchanged. This allows a constant amount of weft to be wound on the storage drum by the weft guide, but involves the disadvantage that the storage drum cannot accommodate itself to a change in the length of weft necessary for one weft insertion, which change may be caused for some reason such as an error in the manufacturing and assembling of the loom.

In order to remove the above disadvantages of said drum type device, Japanese patent specification No. 50-31229 has disclosed an arrangement comprising a plurality of endless belts each consisting of a timing belt arranged in parallel with and equidistant from the other timing belts in the direction of weft insertion, and a plurality of length determining pins provided in each of the endless belts so as to project therefrom. The length of weft necessary for each weft insertion is successively wound between the preceding and succeeding length measuring pins and, at the same time, the weft wound between other preceding and succeeding pins is released to be inserted through the warp shed.

However, it will be understood that the above-discussed device of said Japanese patent specification includes, in addition to said plural end belts and length measuring pins, a complex driving means comprising driving and driven rollers and so on. This makes the arrangement difficult to manufacture, assemble, inspect and repair.

It is therefore a primary object of this invention to provide a weft length measuring device which allows a reliable, stable and speedy weft inserting operation and has a simple structure making said measuring device easy to manufacture, assemble, inspect and repair.

It is another object of this invention to provide a weft length measuring device which provides a reduced area of contact between a weft storage drum and a weft, thereby to decrease the frictional resistance therebetween.

A further object of this invention is to provide a weft length measuring device the weft storage drum of which can be changed in diameter so that the length of weft to be wound thereon is adjustable.

SUMMARY OF THE INVENTION

In general, a weft length measuring device made in accordance with this invention comprises a weft storage drum supported against rotation, and a winding and guiding member supported for rotation around the storage drum to wind weft from a weft supply bobbin on the storage drum. The measuring device further comprises a length measuring control pin and a weft unwinding control pin, as a pair, arranged at axially spaced positions in the weft storage drum and operated by a cam mechanism so as to alternately project out of the weft storage drum, and a weft transfer member arranged on the outer periphery of the weft storage drum to cause the weft for one weft insertion, the length of which has been measured by the rearward, length measuring pin, to be transferred toward the forward, weft unwinding control pin. During the weft inserting operation during which the weft wound on the drum is unwound, succeeding weft for the next weft insertion can be continuously and exactly wound on the storage drum.

The weft storage drum may be provided with a plurality of projections extending in the direction in which the weft to be unwound moves. These projections allow the weft to be wound on the weft storage drum in a partial contact relationship, thus decreasing the contact area. Furthermore, the weft storage drum may consist of at least two members, one of which is adjustable in position so that the diameter of the weft storage drum can be changed.

BRIEF DESCRIPTION OF THE DRAWINGS

This invention will become more readily apparent from the following description of preferred embodiments thereof shown, by way of example only, in the accompanying drawings wherein.

DESCRIPTION OF THE PREFERRED EMBODIMENTS

Figure 1:
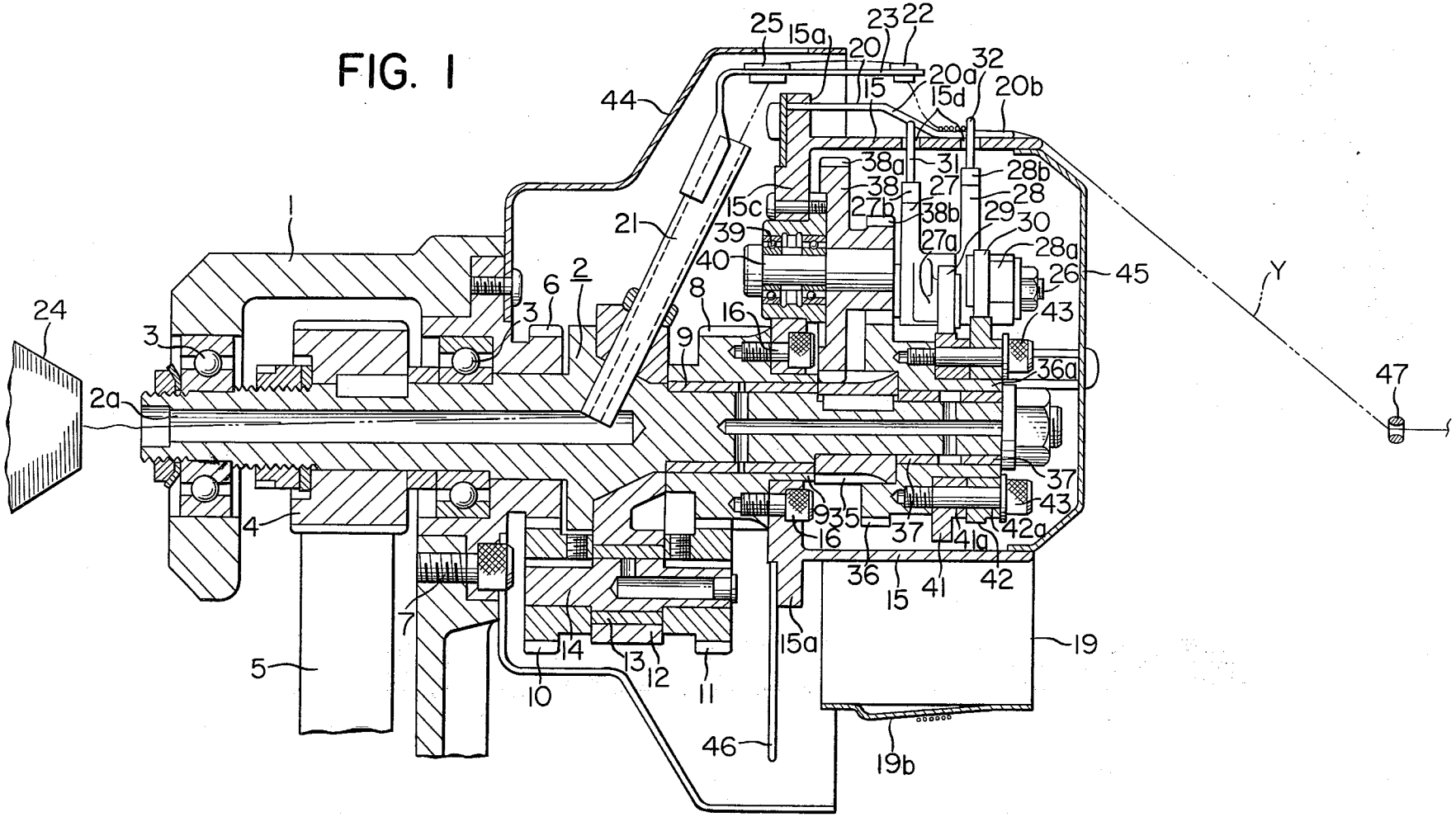
FIG. 1 is a longitudinal sectional view showing an embodiment of a weft length measuring device according to this invention.
Figure 2:
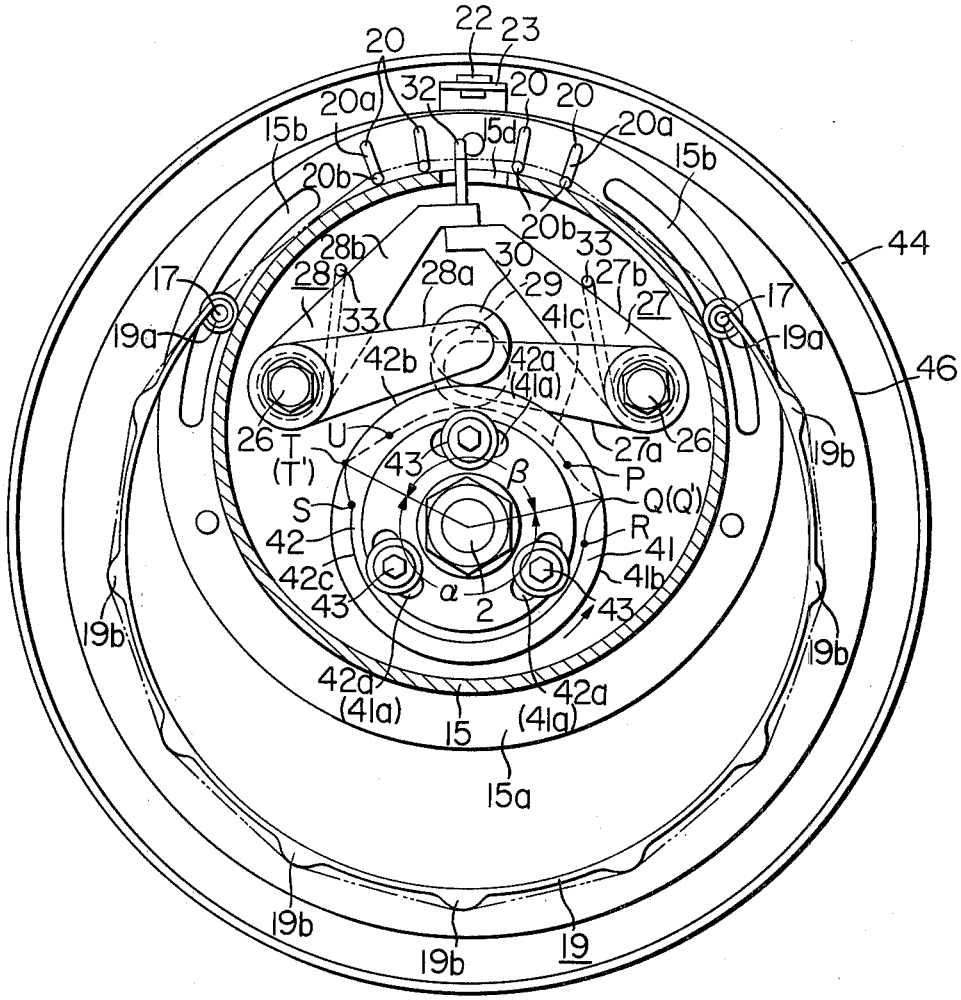
FIG. 2 is a front elevational view showing the measuring device of FIG. 1 with parts being removed for simplification.

Referring to the drawings, particularly to FIGS. 1 and 2, there is shown a weft length measuring device mounted on a bracket 1 positioned on one side of the frame (not shown) of a shuttleless loom. The measuring device comprises a rotatable support spindle 2 supported for rotation through bearing means 3 by the bracket 1 and extending in the direction of weft insertion (rightward in FIG. 1) through a pulley 4 secured to the spindle 2 by a conventional means, such as a key. The pulley 4 is operatively associated with a timing belt 5 driven in synchronism with the weaving cycle of the loom. Thus, the spindle 2 is positively driven by the timing belt 5.

In order to maintain a housing 15 in a stationary condition, a specific planetary gear mechanism is provided which comprises a first sun gear 6 disposed around the spindle 2 and secured to the bracket 1 by bolts 7, a second sun gear 8 circumferentially mounted through a pair of bearing metals 9 on the rather mid portion of the spindle 2, and a pair of planet gears 10 and 11 key connected to the opposite end portions of a connecting pin 14 mounted for rotation through a bearing metal 13 in a planet gear holder 12 fixedly connected around the spindle 2. The planet gears 10 and 11 mesh with the first and second sun gears 6 and 8, respectively. The number of gear teeth of the first sun gear 6 and the planet gear 10 are equal to those of the second sun gear 8 and the planet gear 11, respectively, so that the second sun gear 8 is always maintained in the stationary condition even if the planet gears 10 and 11 are rotated through the holder 12 and the pin 14 by the spindle 2.

Figure 3:
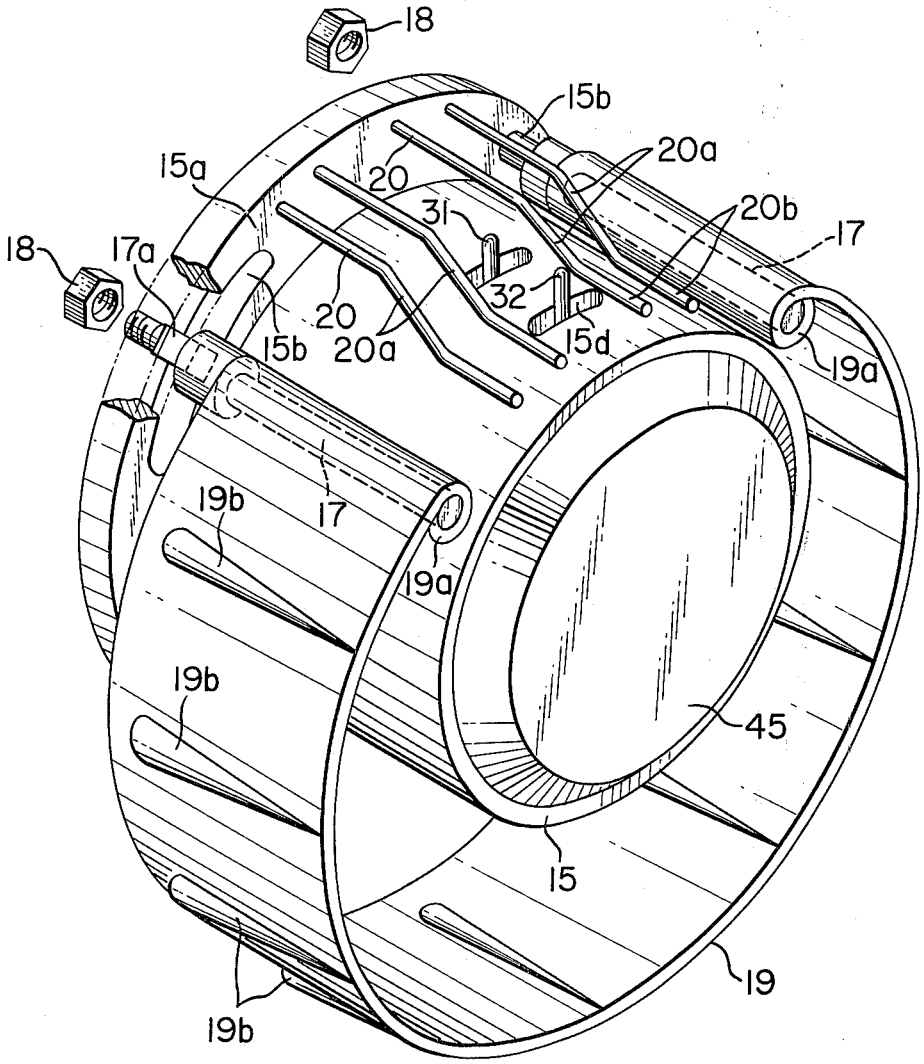
FIG. 3 is a perspective view showing, on an enlarged scale, the weft storage drum employed in the measuring device of FIG. 1.

The afore-mentioned housing 15 and of a substantially cylindrical shape and is attached to the forward side of the second sun gear 8 by bolts 16 and is therefore also maintained in the stationary condition. As best shown in FIG. 3, the housing 15 is provided on its rearward side with an annular flange 15*a*. In the relatively upper portion of the flange 15*a*, a pair of arcuated slots 15*b* are provided in a symmetric manner. A pair of support pins 17 have their root portions 17*a* in the form of rectangular columns inserted in the corresponding slots 15*b* in a manner allowing adjustment of the position of either pin 17. For fixing the position of either pin 17, it is provided with a threaded portion and an increased diameter portion on the opposite ends of the column 17*a* as shown in FIG. 3, and a nut 18 is engageable with the threaded portion from the rear of the flange 15*a*.

A weft storage drum, generally referred to by the reference numeral 19, is formed of a curved metallic belt which defines a substantially cylindrical shape in cooperation with four weft storage bars 20 as shown in FIG. 3. The opposite cylindrical ends 19*a* of the belt are fixedly fitted onto the corresponding pins 17 by caulking. On the outer surface of the drum 19, a plurality of projections 19*b* are equidistantly provided by stamping so as to be tapered down toward the forward side of the drum 19 (rightward in FIG. 3). These projections 19*b* cause the contact area of the drum 19 with the weft Y to be greatly decreased, as can be seen in FIG. 2, resulting in reduced frictional resistance being applied to the weft Y when it is rewound. Their tapered shape causes the effective circumference of the drum 19 to decrease in the direction of weft withdrawal. The storage bars 20 are connected at their one end to the flange 15*a* and extend in parallel to each other in the direction of the weft insertion through the vacant space between the ends 19*a* of the belt 19. The storage bar 20 is bent in a manner allowing its mid portion to gradually approach the outer periphery of the housing 15 as the bar 20 extends in the direction of the weft insertion. It can therefore be understood that the mid portion of each storage bar 20 provides an inclined portion 20*a* capable of causing the weft to be slidingly transferred forward, i.e., in the direction of the weft insertion.

Referring back to FIG. 1, a yarn guide conduit 21 obliquely extends through the planet gear holder 12 into the spindle 2 to be in communication with an axial path 2*a* provided in the spindle 2. Fixedly connected to the upper end of the conduit 21 is a support arm 23, to which an annular, weft guiding and winding member 22 is attached. With such an arrangement, during the rotation of the spindle 2, the weft guiding and winding member 22 is rotated around the weft storage drum 19 and bars and 20 with the conduit 21 and the support arm 23 so that the weft on the weft supply bobbin 24 disposed at the rear of the spindle 2 is caused to pass through the axial path 2*a*, the conduit 21 and a ring 25 fixed to the arm 23 and to be wound in the form of a coil around the weft storage drum 19 and bars 20.

Figure 4:
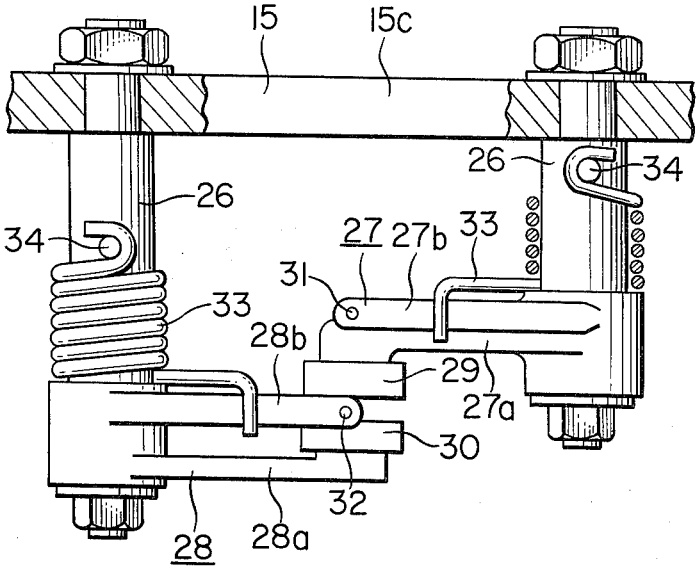
FIG. 4 is a plan view, partly shown in section, of a structure for mounting the measuring and unwinding length control pins.

The measuring device further comprises a mechanism disposed within the housing 15 for supporting and driving a length measuring control pin 31 and an unwinding control pin 32 arranged as a pair. The length measuring pin 31 serves retain the weft thread while it is being wound on drum 19 to measure the length of the weft necessary for one weft insertion, and the unwinding control pin 32 serves to release the measured weft to be inserted through the warp shed during the measuring. As shown in FIGS. 1, 2 and 4, the control pin supporting and driving mechanism includes a pair of support pins 26 extending through and fixed to the bottom plate 15*c* of the housing 15, a pair of forked operating levers 27, 28 rotatably supported by the respective pins 26 at their free ends, and a pair of cam followers or rollers 29, 30 rotatably supported by lower arm portions 27*a*, 28*a* of said levers 27, 28 respectively. As shown in FIGS. 1 and 2, the cam followers 29 and 30 can rotate on first and second cam plates 41 and 42, respectively.

Figure 5:
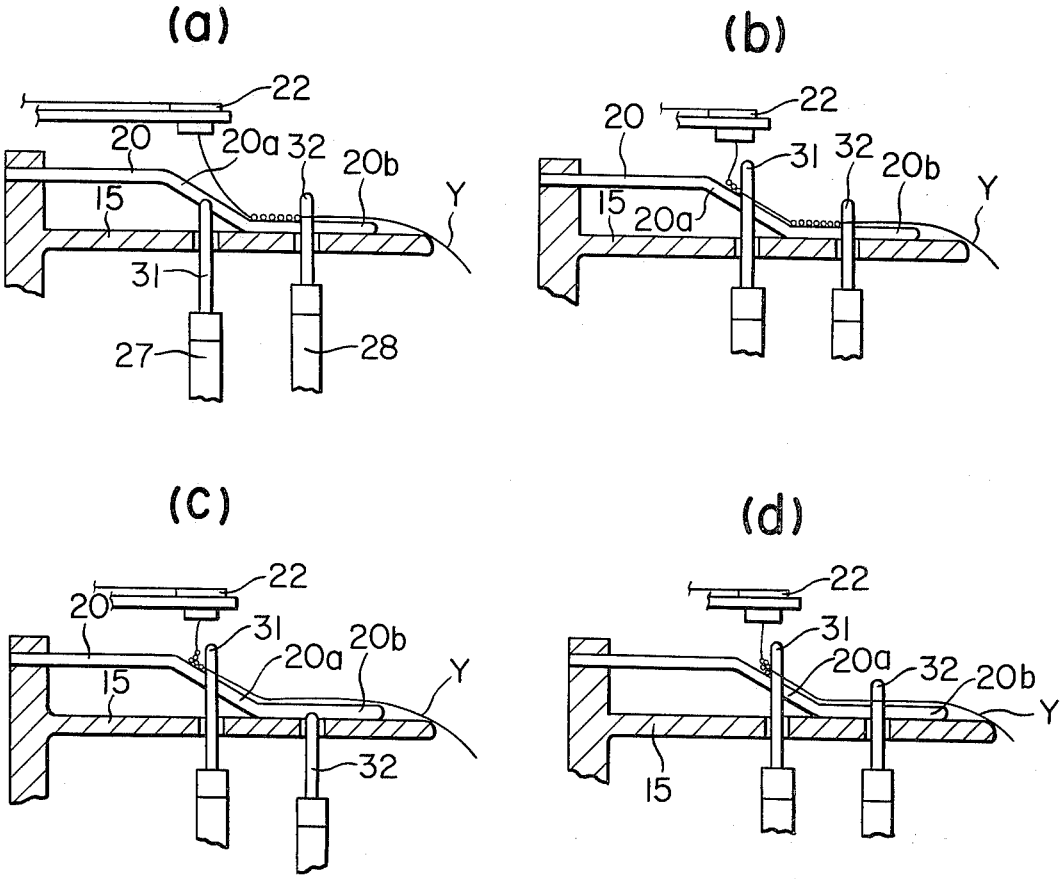
FIGS. 5(*a*) to (*d*) are sectional views explaining the various steps of the operation for the measuring and unwinding length control.

The length measuring pin 31 is connected to the upper arm portion 27*b* of the operating lever 27 so as to extend upwardly through the opening 15*d* provided in the housing 15. The length measuring pin 31 can project beyond and withdraw below the inclined portions 20*a* of the intermediate storage bars 20 through the vacant space therebetween. When the length measuring control pin 31 is in the projected position shown in FIGS. 5(*b*) to (*d*), the yarn Y supplied through the winding member 22 is wound around the drum 19 and the upper parts of the inclined portions 20*a*. When the length measuring control pin 31 is withdrawn downward below the inclined portions 20*a* as shown in FIGS. 1 and 5(*a*), the weft Y is caused to slide down along the inclined portions 20*a* toward the forward horizontal portions 20*b* due to its own tension.

The weft unwinding control pin 32 is connected to the upper arm portion 28*b* of the operating lever 28 so as to extend upwardly through the opening 15*d* provided in the housing 15. The unwinding control pin 32 can project beyond and withdraw below the horizontal portions 20*b* of the intermediate storage bars 20 through the vacant space therebetween. When the unwinding control pin 32 is in the projected position as shown in FIGS. 1, 5(*a*), 5(*b*) and 5(*d*), the unwinding of the yarn Y wound on the horizontal portions 20*b* is inhibited. When the unwinding control pin 32 is withdrawn below the horizontal portion 20*b* shown in FIG. 5(*c*), the weft is released from the restriction by the unwinding control pin 32 and can be rewound from the storage drum.

As shown in FIG. 4, the control pin supporting and driving mechanism further includes a pair of biassing springs 33 each fitted at one hook end onto a contact pin 34 (provided on the respective pin 26), wound at the intermediate portion around the pin 26, and biased at the other end against the upper arm portion 27*b* or 28*b* of the operating lever 27 or 28. The springs 33 are adapted to bias the corresponding control pins 31 and 32 in the direction in which they are withdrawn. Referring to FIG. 1, there is a gear train within the housing 15, which comprises a driving gear 35 fixedly mounted around the spindle 2 by a key, a driven gear 36 rotatably mounted through a bearing metal 37 around the forward end of the spindle 2, and a reduction gear 38 attached to an intermediate shaft 40 rotatably supported through bearings 39 by the bottom plate 15*c* of the housing. The reduction gear 38 comprises larger and smaller diameter gears 38*a* and 38*b* meshing with the driving and driven gears 35 and 36, respectively. The aforementioned cam plates 41 and 42 for vertically moving the associated cam followers 29 and 30 are mounted around the forward portion 36*a* of the driving gear 36 and fixed thereto by bolts 43. The angular positions of the cam plates 41 and 42 with respect to the driving gear are adjustable because openings 41*a*, 42*a* provided in the cam plates 41 and 42 to allow the bolts 43 to pass therethrough are in the form of an oblong slot.

It is to be noted that during one cycle of the weft insertion, the winding and guiding member 22 is adapted to make a suitable number of rotations together with the spindle 2 to wind the length of yarn necessary for one weft insertion around the weft storage drum and bars 19 and 20, and that the number of teeth of each of the gears 35, 38 and 36 is so selected that the cam plates 41 and 42 make a complete rotation during one cycle of the weft insertion. Also, the cam surfaces of the cam plates 41 and 42 are profiled to cause the length measuring and weft unwinding control pins 31 and 32 to be projected beyond the storage bars 20 alternatively once during the complete rotation of the cam plates 41 and 42. In other words, as shown in FIG. 2, the cam surface of the first cam plate 41 is defined by a larger diameter portion 41*b* involving an angle of $\alpha=220°$ and a smaller diameter portion 41*c* involving an angle of $\beta=140°$, whereas the angles involved in larger and smaller diameter portions 42*b* and 42*c* of the second cam plate 42 are completely reversed relative to the first cam plate 41.

In FIG. 1, a cover 44 is attached to the first sun gear 6 and extends forward to cover the planetary gear mechanism 6, 8, 10 and 11, the weft guide conduit 21, most of the support arm 23, and so on. A cap 45 is attached to the forward end of the housing 15 and a cover plate 46 is attached to the rear of the flange 15*a*. Disposed in front of the weft storage drum 19 is a weft guide ring 47. A not shown weft inserting apparatus which carries out the insertion of the weft with air, water or a gripper, is disposed in front of the ring 47.

The operation of the above weft length measuring device will now be described.

FIGS. 1, 2 and 5(*a*) show the condition in which the length measuring control pin 31 is withdrawn downward from the vacant space between the inclned portions 20*a* of the storage bars 20 and the unwinding control pin 32 is projected above the horizontal portions 20*b* to inhibit the wound yarn Y from being unwound. In such a condition, the length of yarn necessary for one weft insertion has not yet been wound and the winding member 22 is rotating around the weft storage drum 19 to continue the winding of the weft thereon. Also, the first and second cam plates 41 and 42 are rotating in the counterclockwise direction in FIG. 2. However, when the termination point P of the smaller diameter portion 41*c* of the first cam plate 41 reaches the cam follower 29, the projection of the length measuring control pin 31 is commenced as shown by "P" in FIG. 6, and the length measuring control pin 31 is brought into the fully projected position shown in FIGS. 5(*b*) and 6 (see "Q") when the start point Q of the larger diameter portion 41*b* engages the cam follower 29. When in the fully projected position, the length measuring control pin 31 receives the weft supplied through the winding member 22 and causes it to be wound on the upper, leftward or rearward parts of the inclined portions 20*a*. The length of weft necessary for one weft insertion has been wound between the fully projected control pins 31 and 32.

When the start point Q of the larger diameter portion 41*b* of the first cam plate 41 is in contact with the cam follower 29, the termination point Q' of the larger diameter portion 42*b* of the second cam plate 42 urges the cam follower 30 upwardly. Therefore, the control pin 32 is maintained in the fully projected position. Upon further rotation of the first and second cam plates 41 and 42, the start point R of the smaller diameter portion 42*c* of the second cam plate 42 comes into contact with the cam follower 30, then the unwinding control pin 32 is fully withdrawn below the horizontal portions 20*b* of the storage bars 20 as shown in FIG. 5(*c*) and FIG. 6 (see "R"). Immediately thereafter, the weft insertion is commenced as shown by "X" in FIG. 6, and the weft wound on the storage drum 19 is unwound and inserted into the warp shed by the not shown weft inserting apparatus.

Figure 6:
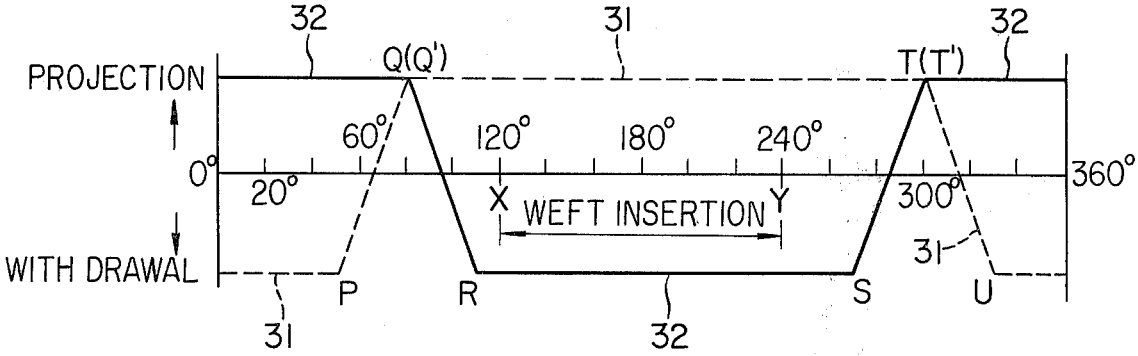
FIG. 6 is a view diagrammatically showing the steps of the operation illustrated in FIGS. 5(*a*) to (*d*)

When the weft insertion is completed as shown by "Y" in FIG. 6, the weft stored between the control pins 31 and 32 is just completely unwound. Thereafter, when termination point S of the smaller diameter portion 42c of the second cam plate 42 comes in contact with the cam follower 30, the projection of the unwinding control pin 32 is commenced as shown by "S" in FIG. 6, and the unwinding control pin 32 is brought into the fully projected position, as shown in FIG. 5(*d*) and FIG. 6 (see "T") when, the start point T of the larger diameter portion 42b comes in contact with the cam follower 30. At this time, the termination point T' of the larger diameter portion 41b of the first cam plate 41 is in contact with the cam follower 29. Upon further rotation, the start point U of the smaller diameter portion 41c of the first cam plate 41 pushes the cam follower 29, then the length measuring pin 31 is brought into the full withdrawn position as shown in FIG. 5(*a*) and FIG. 6 (see "U"). Therefore, the weft wound on the upper rearward part of the inclined portion 20a is allowed to slide down along the inclined portion 20a onto the forward, horizontal portion 20b and is received by the projected unwinding control pin 32. Thereafter, the aforementioned steps are repeated.

It can be understood from the foregoing that in the above embodiment of this invention, the cam mechanism is employed to alternately project the length measuring control pin 31 which retains the thread being wound while measuring the length of the weft and the unwinding control pin 32 which receives and holds the measured weft, until the commencement of the weft insertion from the weft storage drum 19, and the inclined portions 20a of the weft storage bars 20 are for transferring the weft, wound around the storage drum 19 and the storage bars 20, toward the unwinding side thereof. Therefore, it becomes possible to wind the exact length of a weft necessary for one weft insertion on the weft storage drum 19, and during this winding operation the weft wound on the storage drum at the preceding winding operation can be unwound to be inserted into the warp shed. Also, since the cam mechanism is of a simple structure comprising operating levers and cam plates, the measuring device can be easily manufactured, assembled, inspected and repaired.

Furthermore, according to the embodiment of this invention, since the outer surface of the weft storage drum 19 is provided with the projections 19b circumferentially disposed in equidistant relationship and extending in parallel with each other toward the weft unwinding side, the weft wound on the weft storage drum 19 is allowed to contact only the projections 19b and is subject to reduced friction. This means that the weft can be unwound with reduced resistance, resulting in a reliable weft inserting operation in a shuttleless loom utilizing a fluid flow or a gripper to insert the weft into the shed. Also, the projection 19b may be tapered down so that its dimension in the radial direction is gradually reduced when it approaches the forward end of the storage drum 19. This further reduces the resistance between the weft and the storage drum 19 occurring during the weft unwinding.

Furthermore, according to the embodiment of this invention, since at least one of the cylindrical end portions 19a of the storage drum 19 is adjustably connected through the pins 17 to the flange 15a of the housing 15, the diameter of the storage drum 19 can be changed by adjusting the position of the cylindrical end portion 19a. This means that the length of weft necessary for one weft insertion can be changed as desired.

It is stated that this invention is not limited to the above-discussed details of the embodiment. For example, the following various rearrangements of parts and modifications of parts may be accomplished without departing from the spirit and scope of the invention:

(1) A weft storage member(s) in the form of a plate having the same function as the weft storage bars 20 may be employed in lieu of the weft storage bars 20.

(2) The weft storage drum may be formed in a cylinder continuous in the circumferential direction and having an inclined portion at a position corresponding to that of the length measuring control pin 31.

(3) The projections 19b may be separate members capable of being attached to the storage drum 19 by any suitable means.

Figure 7:
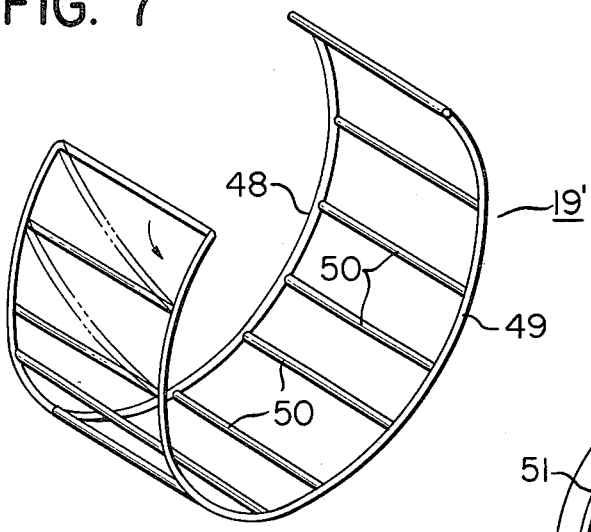
FIGS. 7 to 9 are views showing different modifications of the embodiment shown in FIGS. 1 to 6.

(4) In lieu of the drum 19, a framework structure 19' as shown in FIG. 7 may be employed, which comprises a pair of first and second axially spaced, circumferentially curved wires 48 and 49, and a number of circumferentially equidistant wires 50 axially extending in parallel to each other and connected at their opposite ends to the wires 48 and 49.

(5) As shown in FIG. 7 by the phantom line 50a, the wires 50 may be inclined with respect to the axis of the framework structure 19'.

Figure 8:
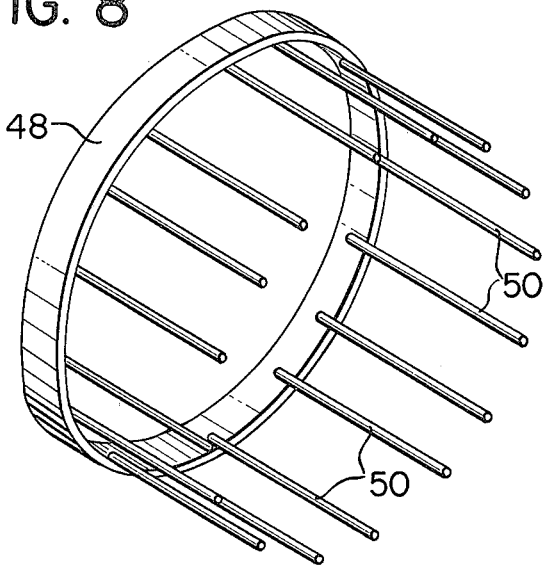

(6) As shown in FIG. 8, the second wire 49 (FIG. 7) may be omitted. In this case, the first wire 48 is formed in a continuous ring.

Figure 9:
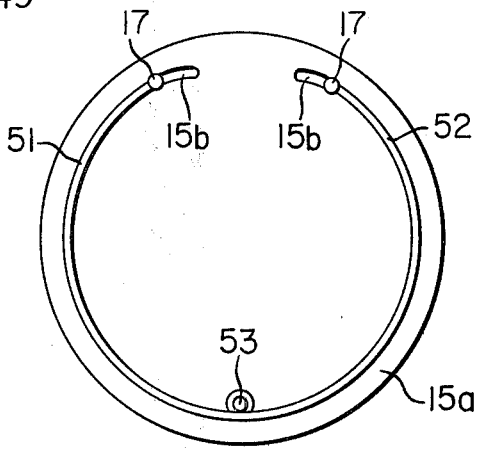

(7) As shown in FIG. 9, rigid curved plate members 51 and 52 forming a weft storage drum are supported at their lower portions by a pin 53 attached to the flange 15a of the housing 15 in a manner allowing their pivotal movement about the pin 53. The upper portions of the plate members 51 and 52 are adjustably supported by the pins 17.

Although the first embodiment shown in FIGS. 1 to 6 employs the planetary gear mechanism as a mechanism to maintain the housing 15 and accordingly the weft storage drum 19 in the stationary condition, an electromagnetic device as employed in the different embodiment shown in FIGS. 10 to 13 may be utilized in lieu of the planetary gear mechanism.

The arrangement and operation of such an electromagnetic device is now described in conjunction with FIGS. 10 to 13.

Figure 10:
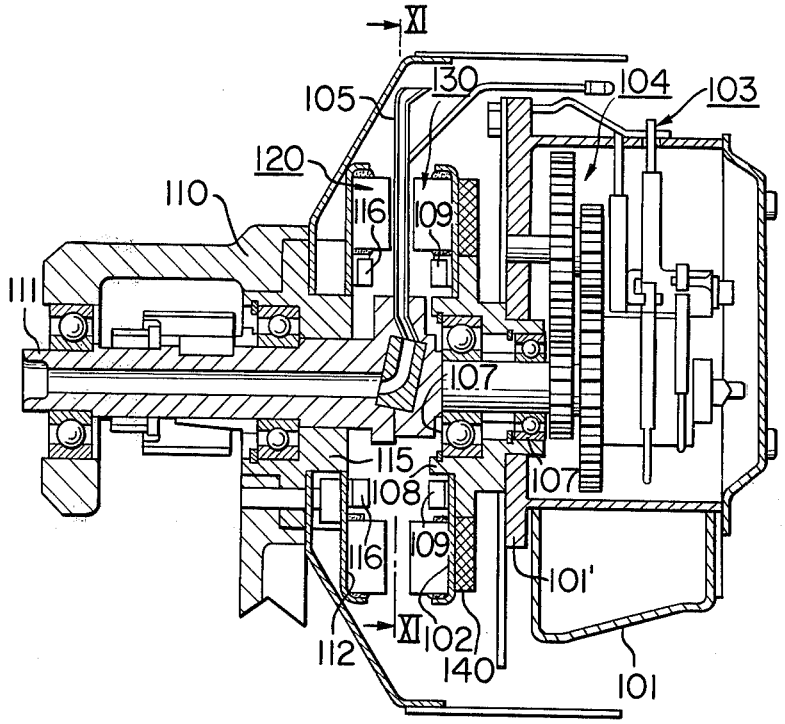
FIG. 10 is a longitudinal sectional view showing another embodiment of this invention.

Referring to FIG. 10, there is shown a second embodiment of the weft length measuring device comprising a weft storage 101 on which a weft is wound to be measured, a pair of weft measuring and unwinding control pins 103, a mechanism 104 for driving the control pins 103, a weft winding and guiding member 105, and a mechanism 120, 130, 140 for maintaining the storage drum 101 in the stationary condition. Since the mechanism 101, 103, 104 and 105 may be the same as in the first embodiment shown in FIGS. 1 to 6, the detailed descriptions thereof can be omitted.

As shown in FIG. 10, the drum 101 is connected to a flange 108 supported through bearings 107 by a rotary spindle 111. The mechanism for maintaining the drum in the stationary condition is composed of a plurality of magnet assemblies 130 and 120 disposed on the drum side and the stationary side, respectively. More specifically, the magnet assembly 130 on the drum side is attached to a magnet mounting plate 102 consisting of an annular flat plate, which is connected to the flange 108 by fitting bolts 109 so as to extend perpendicular to the axis of the rotary spindle 111, while the magnet assembly 120 on the stationary side is attached to a magnet mounting plate 112 consisting of an annular flat plate, which is connected to a stationary flange 115 by fitting bolts 116 so as to oppose the magnet mounting plate 102. The stationary flange 115 is attached to a weaving machine frame 110 and supports the rotary spindle 111 for rotation.

Figure 11:
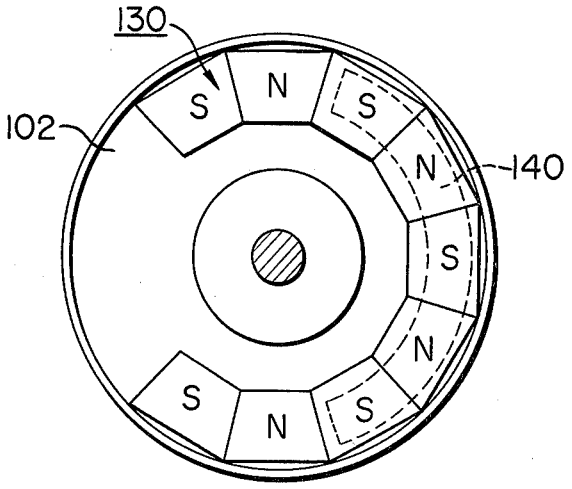
FIG. 11 is a cross-sectional view taken on the line XI—XI of FIG. 10.
Figure 12:
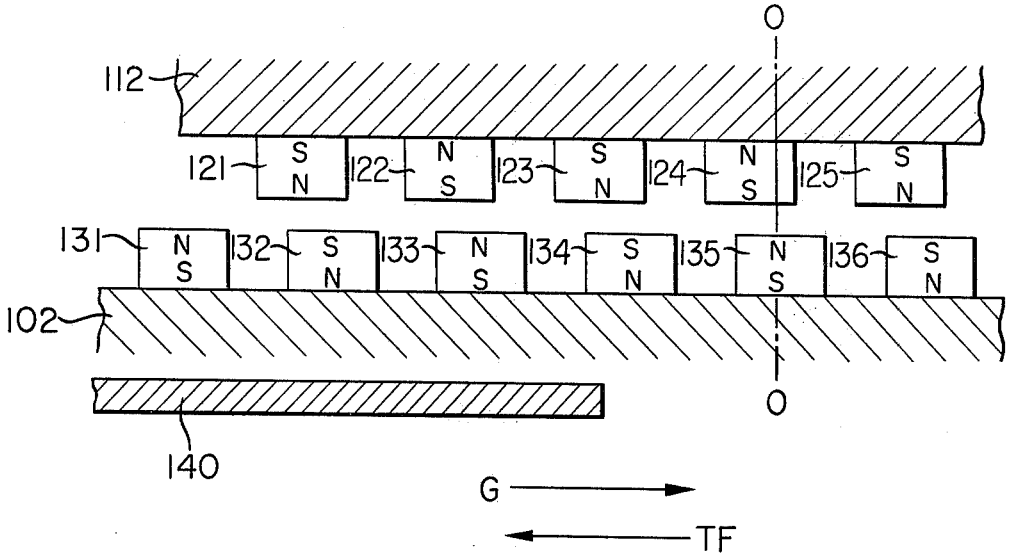
FIG. 12 is a development showing an arrangement of magnets in the embodiment of FIG. 10.

In FIG. 12 showing the development of the magnet assemblies 120 and 130, magnets 121 to 125 forming the magnet assembly 120 are spacedly disposed on the mounting plate 112 so that their S and N poles alternate with each other. Magnets 131 to 136 forming the magnet assembly 130 are disposed in a similar manner. A weight 140 is provided on the drum side so that an offset is slightly provided between the magnet assemblies 120 and 130. In this example, the weight 140 is of an arcuated form as shown in FIGS. 11 and 12 and provided rightward on the rear of the mounting plate 102 in FIG. 11 so that the mounting plate 102 is always urged in the clockwise direction by the weight 140. The magnet assembly 130 on the drum side may be directly attached to the end face 101' of the drum 101. In FIG. 12, the position on the line 0—0 corresponds to that of the lowermost portion of the mounting plate 112 on the stationary side. Since the drum 101 is supported for rotation through the bearings 107 around the spindle 111, the magnet mounting plate 102 can move in either of the rightward and leftward directions as viewed in FIG. 12.

It is again stated that, as can be understood from FIGS. 11 and 12, since the force of gravity G is applied to the magnet mounting plate 102 by the weight 140 to rotate the magnet mounting plate 102 in the clockwise direction in FIG. 11, the magnets 131 to 136 on the magnet mounting plate 102 on the drum side and the magnets 121 to 125 on the magnet mounting plates 112 on the stationary side are always maintained in the condition that they are offset in one direction. Between any one of the magnets 131 to 135 and any one of the magnets 121 to 125, an attractive or expulsive force proportional to the square of the distance therebetween is applied. For example, the magnet 134 on the drum side is subject to the forces of the magnets 121 to 125 on the stationary side. However, most of the force applied on the magnet 134 is produced by the magnets 123 and 124 nearer to the magnets 134 than the other magnets 121, 122 and 125. It is therefore understood that the forces applied on the magnet 134 by the magnets 121, 122 and 125 are negligible.

Figure 13:
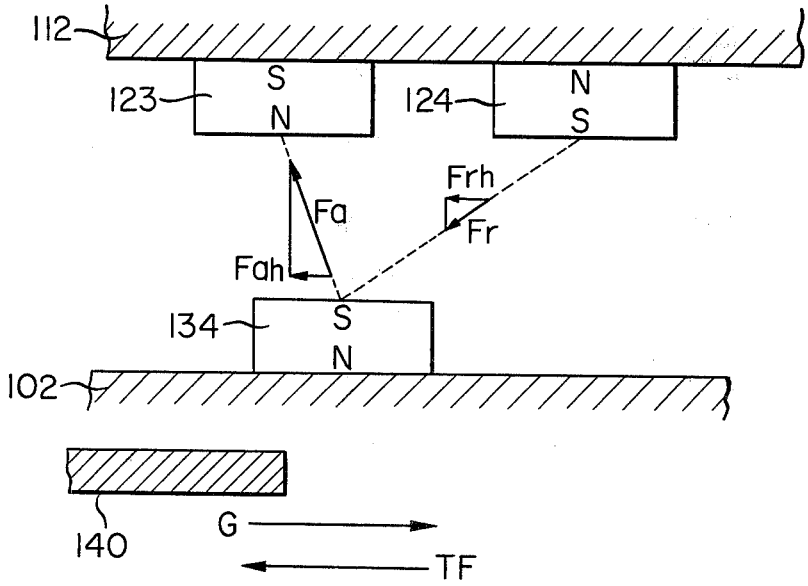
FIG. 13 is a view explaining the magnetic actions between the specific magnets.

In FIG. 13, on the magnets 134 on the drum side, an attractive force Fa by the magnet 123 and an expulsive force Fr are applied. Therefore, the resultant F of horizontal components Fah and Frh of the forces Fa and Fr is applied on the magnet 134 in the leftward direction. Each of the residual magnets 131 to 133, 135 and 136 is also subject to such a resultant directed leftwards. Therefore, the mounting plate 102 is urged leftwards by the sum TF of these resultants. The sum TF and the force of gravity G are balanced so that the drum is maintained stationary relative to the stationary side with the magnet assemblies 120 and 130 being offset by each other. Since the directions of the sum TF and the force of gravity G are opposite to each other, even if an external force is generated causing the drum to be moved in either the leftward or rightward direction, a force against the external force is generated naturally, assuring that the drum is maintained in the stationary condition. More specifically, in FIG. 12, even when the external force tending to move the magnet mounting plate 102 leftward is applied, since the movement of the mounting plate 102 by the external force must be effected against the gravity of the weight 140, it can be prevented. When the external force tending to move the magnet mounting plate 102 rightward is applied, the rightward movement of the mounting plate 102 can be prevented by the magnetic force.

It will be understood that the magnitude of said sum TF of the horizontal components can be changed, changing the positional relationship between the magnet assemblies 120 and 130. For example, if the axial distance between the magnet mounting plates is decreased or the circumferential spacing between the magnets of each assembly is decreased, said sum TF can be increased.

It is apparent from the foregoing that the magnetic mechanism according to this invention prevents the drum from being rotated by an external force applied thereto outwardly of the measuring device, such as the vibrations of the loom, thus assuring that the drum is maintained in the stationary condition.

What we claim is:

1. A device for measuring the length of weft to be inserted into the warp shed of a shuttleless loom, comprising a weft storage drum, means for maintaining the weft storage drum in a stationary condition, weft guiding and winding means mounted for rotation around the weft storage drum for guiding the weft supplied from a weft supply bobbin to the weft storage drum and for winding it in a coil on the weft storage drum, said weft storage drum having means defining an outer, substantially peripheral surface, and a free end from which the wound weft is unwound from the drum as it is being inserted into the warp shed, a length measuring control pin for retaining the weft as it is being wound on said drum to remove the weft length necessary for one weft insertion as determined by the diameter of the weft storage drum, a weft unwinding control pin spaced from said length measuring control pin in the axial direction and towards said free end of said weft storage drum for storing the length of measured weft on the weft storage drum until the commencement of the weft insertion, a cam mechanism disposed substantially within said drum for supporting the control pins in said axially spaced relationship and for driving them so as to selectively project above, and recede to respective positions substantially within said drum from the outer peripheral surface of the weft storage drum, and means responsive to said receding of said length measuring control pin for transferring the weft wound on the weft storage drum toward said drum free end and to a position within said axial spacing between said pins, said means defining said peripheral surface of said drum comprising at least two surface-defining portions at least one of which is radially adjustable for selectively changing the effective diameter of said weft storage drum to correspondingly change said measured weft length.

2. The device set forth in claim 1, wherein said transferring means comprises an axially extending and radially inclined portion provided on each said radially adjustable surface-defining portion of the weft storage drum, the direction of incline of each said inclined portion being away from said free end of the drum.

3. The device set forth in claim 1, wherein said cam mechanism comprises a pair of forked operating levers carrying the respective of said control pins and each supported for pivotal movement with respect to said weft storage drum, respective cam followers mounted on said operating levers, and a pair of rotatable cam plates respectively and operatively engaging said cam followers, said device further conprising a rotary spindle supporting said weft guiding and winding means, and a reduction gear mechanism between said cam plates and said spindle whereby rotation of said spindle rotates said cam plates.

4. The device set forth in claim 1, wherein a plurality of axially extending projections are provided on the outer peripheral surface of the weft storage drum.

5. The device set forth in claim 4, wherein said projections are tapered downwardly towards said free end of the weft storage drum.

6. The device set forth in claim 1, wherein said means defining said peripheral surface of the weft storage drum comprises a circumferentially discontinuous flexible portion having two circumferentially spaced apart ends, at least one of which is supported by support means in a manner allowing the circumferential position thereof to be adjusted.

7. The device set forth in claim 6, wherein said support means comprises a fixed housing having a pair of circumferentially extending, arcuate slots, and respective bolt means supporting said spaced ends of the weft storage drum and respectively positionable within said slots.

8. The device set forth in claim 6, wherein said weft storage drum comprises a flexible plate bent into a circumferentially discontinuous cylinder.

9. The device set forth in claim 6, wherein a second of said surface-defining portions comprises a plurality of axially extending bars mounted in fixed position between said two circumferentially spaced ends of the first said surface-defining portion of the weft storage drum, said bars each having an inclined portion whose incline is in direction away from said free end of the drum.

10. The device set forth in claim 1, wherein said means for maintaining the weft storage drum in the stationary condition comprises a planetary gear mechanism.

11. The device set forth in claim 1, wherein said means for maintaining the weft storage drum in the stationary condition comprises a magnetic device including a first magnet assembly having magnets circumferentially disposed on the weft storage drum, a second magnet assembly having magnets circumferentially disposed on a stationary portion of said weft length measuring device so as to oppose to said first magnet assembly, and means for causing the magnets of said first and second magnet assemblies to be offset with respect to each other.

12. The device set forth in claim 11, wherein said means for causing the magnets of said first and second magnet assemblies to be offset with respect to each other comprises a weight mounted on the weft storage drum.

13. The device set forth in claim 11, wherein the magnets of each of said first and second magnet assemblies are equidistantly disposed with their north and south poles being alternated.

* * * * *